United States Patent [19]

Yoshizaki et al.

[11] Patent Number: 4,611,558

[45] Date of Patent: Sep. 16, 1986

[54] VALVE ACTUATING APPARATUS IN INTERNAL COMBUSTION ENGINE

[75] Inventors: Kouji Yoshizaki; Toshio Tanahashi, both of Susono, Japan

[73] Assignee: Toyota Jidosha Kabushiki Kaisha, Aichi, Japan

[21] Appl. No.: 778,304

[22] Filed: Sep. 20, 1985

[30] Foreign Application Priority Data

| | | | |
|---|---|---|---|
| Oct. 12, 1984 | [JP] | Japan | 59-153107[U] |
| Jan. 21, 1985 | [JP] | Japan | 60-5319[U] |
| Feb. 13, 1985 | [JP] | Japan | 60-17693[U] |
| Feb. 16, 1985 | [JP] | Japan | 60-19989[U] |

[51] Int. Cl.[4] ..... F02D 13/06

[52] U.S. Cl. ..... 123/90.16; 123/90.27; 123/90.39; 123/90.44; 123/198 F

[58] Field of Search ..... 123/90.15, 90.16, 90.27, 123/90.39, 90.44, 198 F

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters | 123/198 F |
| 4,204,512 | 5/1980 | Brock | 123/90.16 |
| 4,252,093 | 2/1981 | Hazelrigg | 123/198 F |
| 4,380,219 | 4/1983 | Walsh | 123/198 F |
| 4,537,164 | 8/1985 | Ajiki et al. | 123/90.16 |
| 4,556,025 | 12/1985 | Morita | 123/90.16 |

FOREIGN PATENT DOCUMENTS

| | | |
|---|---|---|
| 57-193903 | 12/1982 | Japan . |
| 57-193904 | 12/1982 | Japan . |
| 59-68109 | 5/1984 | Japan . |
| 59-67506 | 5/1984 | Japan . |
| P59-226216 | 12/1984 | Japan . |

*Primary Examiner*—Ira S. Lazarus

*Attorney, Agent, or Firm*—Parkhurst & Oliff

[57] ABSTRACT

A valve actuating apparatus for intake and exhaust valves in an internal combustion engine having a swing rocker arm consisting of two arms rotatably interconnected by means of a connecting shaft, one of the arms being rotatably connected to a rocker arm shaft and the other bearing against a valve stem so that the two arms can selectively occupy an operative position, in which the two arms extend substantially straight to form a single rocker arm, and an inoperative position in which a relative rotation between the two arms takes place to absorb the rotation of the cam. A lock pin is provided in one of the first and second arms to prevent relative rotation of the two arms and to lock them to the operative position, and an actuator for releasing the lock at a predetermined time, the locking means and unlocking means having directions of operation substantially perpendicular to and across the axis of the connecting shaft.

12 Claims, 11 Drawing Figures

Fig. 9
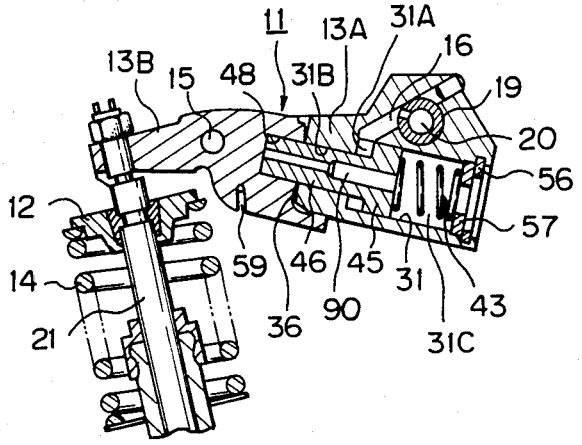
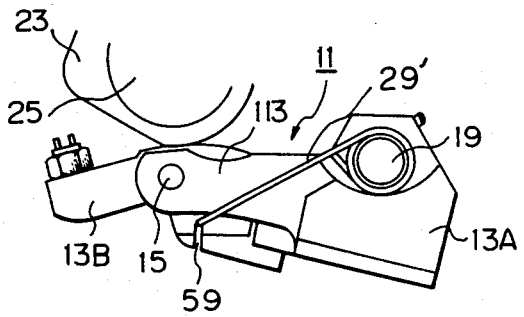
Fig. 10
Fig. 11
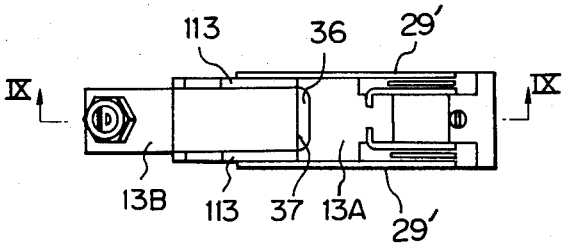

VALVE ACTUATING APPARATUS IN INTERNAL COMBUSTION ENGINE

BACKGROUND OF THE INVENTION

1. Field of the Invention

The present invention relates to a valve actuating apparatus for intake and exhaust valves in an internal combustion engine. More particularly, it relates to a valve actuating apparatus which can render only a predetermined intake and/or exhaust valve or valves inoperative at a given engine condition.

2. Description of the Related Art

In a multi-cylinder internal combustion engine, it is known to selectively render only predetermined intake or exhaust valve(s) inoperative in order to cancel out the associated cylinder(s), thereby controlling the total displacement of the effective cylinders, in accordance with the engine load, resulting in the realization of a variable-cylinder internal combustion engine.

Among known valve actuating apparatuses of the kind mentioned above, those closest to the present invention are disclosed, for example, in Japanese Unexamined Utility Model Publication (Kokai) Nos. 59-68109 and 59-67506, in which a rocker arm is divided into two rocker arm elements, one of which bears against a cam and the other bears against a valve stem of the associated intake or exhaust valve. These two arms are interconnected for relative sliding rotation. The relative sliding rotation takes place between the two arms when only a predetermined intake or exhaust valve is made temporarily inoperative, to absorb the valve lift of the associated valve. The two arms are provided with male and female engaging members which are selectively engaged and disengaged. One of the male and female members can be actuated by an actuator, such as solenoid means to selectively occupy locked and unlocked positions.

However, in the known apparatuses mentioned above, the actuator acts on the male or female member in a direction parallel to the axis of the rocker arm shaft on which the rocker arm is supported, namely in a direction in which the two arm elements tend to separate and, accordingly, the two arm elements originally brought into surface contact are forced to separate from one another. This results in deviation of the arm elements from the respective initial positions or undesirable displacement of the contact portion of the second arm element that bears against the valve stem.

SUMMARY OF THE INVENTION

The primary object of the present invention is, therefore, to provide a simple valve actuating apparatus having so-called swing type (end pivot type) two divided rocker arms which is free from the aforementioned drawbacks and which can selectively cancel out the operation of the desired intake or exhaust valve(s) without deviation of the rocker arm and displacement of the portion of the rocker arm in contact with the valve stem.

To achieve the object mentioned above, according to the present invention there is provided a valve actuating apparatus for intake and exhaust valves in an internal combustion engine having a swing rocker arm which is rotatably connected at one end to a rocker arm shaft and at its opposite end bears against a valve stem of an associated intake or exhaust valve, and a rotatable cam which bears against the swing rocker arm to swing the latter about the rocker arm shaft, wherein said rocker arm is composed of a first arm rotatably connected to the rocker arm shaft and a second arm which bears against the valve stem and which is connected to the first arm by means of a connecting shaft extending parallel to the rocker arm shaft, for relative rotation about the connecting shaft, so that the two arms can selectively occupy an operative position in which the two arms are integral with each other and extend substantially straight so as to form a single rocker arm, and an inoperative position in which a relative rotation between the two arms takes place to absorb the rotation of the cam, and wherein the apparatus comprises locking means between the first and second arms for preventing the relative rotation of the two arms to lock them to the operative position, unlocking means between the first and second arms for releasing the lock at a predetermined time, and return means for continuously biasing the two arms toward the operative position to return them to the operative position when the lock is released, these locking means and unlocking means having directions of operation substantially perpendicular to and across the axis of the connecting shaft.

Other features and objects of the invention will become apparent from the description given below.

BRIEF DESCRIPTION OF THE DRAWINGS

The invention will be described below in detail with reference to the accompanying drawings, which show preferred embodiments of the present invention, and in which:

FIG. 9 is a sectional view of a valve actuating apparatus taken along the line IX—IX in FIG. 11, according to the fourth embodiment of the present invention;

FIG. 10 is a side elevational view of a main part of the apparatus shown in FIG. 9; and, FIG. 11 is a plan view of FIG. 10.

DESCRIPTION OF THE PREFERRED EMBODIMENTS

Figure 1:
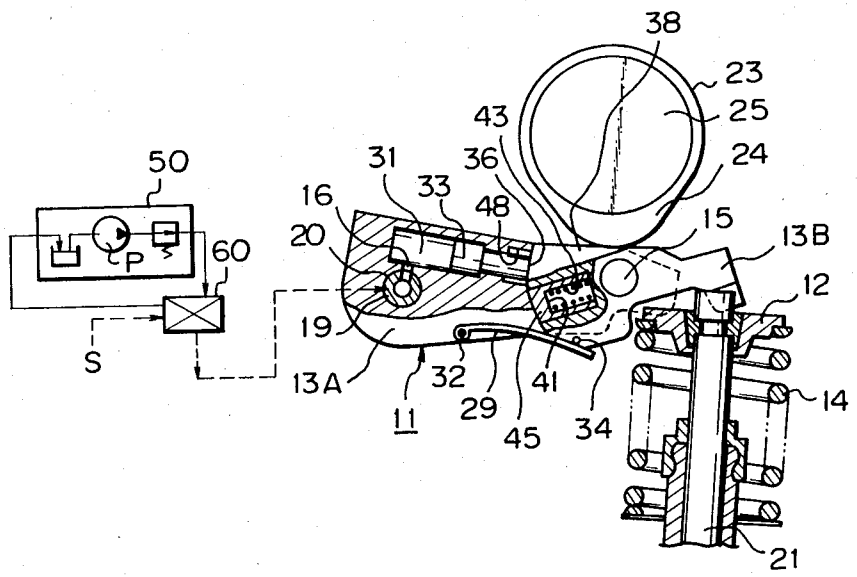
FIG. 1 is a partially sectioned schematic view of a valve actuating apparatus shown in an unlocked, i.e., inoperative position, according to the present invention.

FIGS. 1 to 4 show a first embodiment of the invention, in which a rocker arm 11 consists of two arms, i.e., a first arm 13A which is rotatably connected to a rocker arm shaft 19, and a second arm 13B which is connected to the first arm for relative rotation by means of a connecting shaft 15 and which bears against a top end of a valve stem 21 of an intake or exhaust valve (not shown). This type of rocker arm is known as a swing type or end pivot type, in which the first arm 13A is swingably pivoted to the rocker arm shaft 19. The connecting shaft 15 extends in a direction parallel to the axis of the rocker arm shaft 19 and, accordingly, a cam shaft 25, to which a cam 23 is connected so as to rotate therewith.

As is well known, the cam shaft 25 is synchronously rotated by a crank-shaft (not shown) to rotate the cam 23 connected thereon. The cam 23 bears against the rocker arm 11 at an intermediate portion of the latter to actuate the rocker arm. In the illustrated embodiment, the cam 23 bears against the first arm 13A in the vicinity of the front end of the first arm. It is also possible to bring the cam 23 into contact with the second arm 13B at the intermediate or rear portion thereof.

Figure 2:
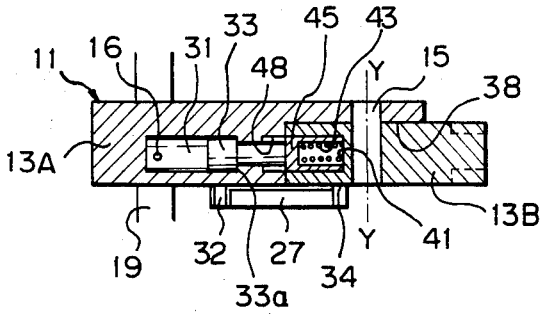
FIG. 2 is an enlarged plan view of a main part of FIG. 1.

The connecting shaft 15 extends through the first and second arms 13A and 13B, which are connected side face to side face for relative sliding rotation about the shaft 15, as can be seen from FIG. 2. The rocker arm 11 can occupy two positions, i.e., an operative position shown in FIGS. 3 and 4 and an inoperative position shown in FIG. 1. In the operative position, the first and second arms 13A and 13B are integral with each other, so that no relative rotation can take place. Namely, the first and second arms 13A and 13B are then equivalent to a conventional single rocker arm, when in the operative position, i.e., locked position as shown in FIGS. 3 and 4.

On the other hand, the first and second arms 13A and 13B can rotate relative to each other when they are in the inoperative position shown in FIG. 1. In the illustrated embodiment, the second arm 13B rotates about the connecting shaft 15 relative to the first arm 13A, so that when the rocker arm 11 is actuated by the cam 23, the first and second arms 13A and 13B are brought into an inclined position in which the second arm 13B largely rotates about the shaft 15 relative to the first arm 13A. In FIGS. 1 and 3, the numerals 12 and 14 designate a retainer mounted to the valve stem 21 and a return spring for the valve, respectively.

Figure 3:
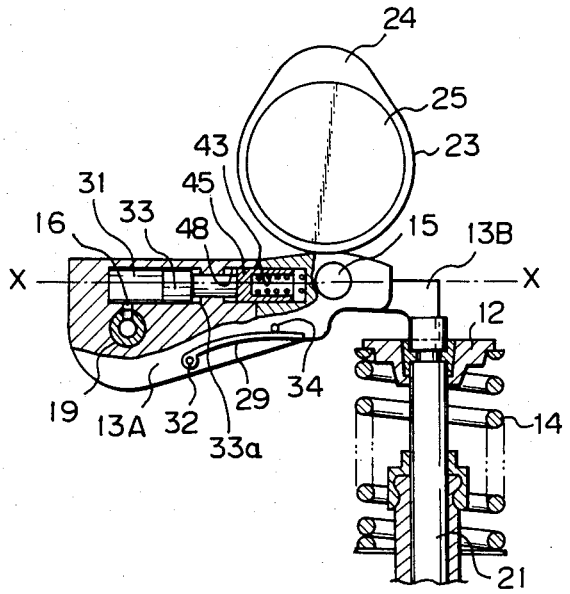
FIG. 3 is a view similar to FIG. 1 but shown in a locked, i.e., operative, position when the valve is in a closed position.
Figure 4:
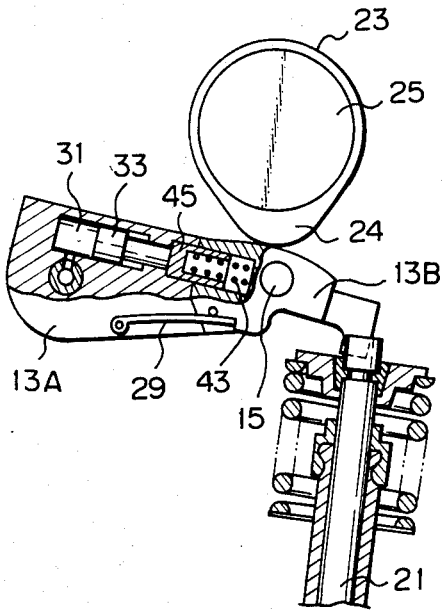
FIG. 4 is a view similar to FIG. 3 but with the valve in an open position.

Between the first and second arms 13A and 13B, is provided a return spring 29 which returns the rocker arm 11, which is located in the inclined position by the cam 23, to the operative position shown in FIGS. 3 and 4 (in which the two arms 13A and 13B extend substantially straight as a single rocker arm) when a cam lobe 24 of the cam 23 separates from the rocker arm 11 during the rotation of the cam 23.

The return spring 29 is made, for example, of a leaf spring connected at one end to a pin 32 provided on the first arm 13A and bearing at the opposite end against a pin 34 provided on the second arm 13B. The return spring is not limited to such a leaf spring and can be a coil spring or the like.

The first and second arms 13A and 13B come into surface contact with each other at a contact surface 38 thereof for relative sliding rotation, as mentioned before. They also are in contact with each other at a curved contact surface 36, which has a radius of curvature substantially identical to an arc of a circle along which the rear end face of the second arm 13B rotates about the shaft 15, so that the second arm 13B can rotate about the shaft 15 while sliding on the curved contact surface 36 of the first arm 13A.

A locking device for preventing the relative rotation of the first and second arms 13A and 13B is provided between the two arms. The locking device is composed of a lock pin 45, which is slidably inserted in a blind hole 41 formed in the second arm 13B by means of a spring 43. The lock pin 45 can be, for example, a movable piston having a generally U-shape section, as shown in FIG. 2. The lock pin 45 is completely retracted in the blind hole 41, which forms a cylinder for the piston 45, in the inoperative position mentioned above. This corresponds to the unlocked position, in which the first and second arms 13A and 13B can rotate relative to each other about the shaft 15.

The lock pin 45 is actuated by an actuator, which is comprised of a piston 33 slidably fitted in a cylinder 31 formed in the first arm 13A. The piston 33 is opposed to the lock pin 45, that is, the piston 33 is located in alignment with the lock pin 45, so that the piston 33 bears against one end of the lock pin 45 at the contact surface 36 between the first and second arms when the rocker arm 11 is in the inoperative position, i.e., when the lock pin 45 is in the unlocked position. In this manner, the second arm 13B can rotate about the shaft 15 relative to the first arm 13A in the unlocked position.

The cylinder 31 is hydraulically connected to a bore 20 of the hollow rocker arm shaft 19 through an oil passage 16 formed in the first arm 13A. The bore 20 of the rocker arm shaft 19 is hydraulically connected to an oil supply unit 50 having an oil pump P, etc., through a switching valve 60, which selectively cuts the supply of the pressurized oil to the bore 20. Namely, the switching valve 60 operates in response to, for example, a signal S representing an engine load, to feed the pressurized oil from the oil unit 50 to the rocker arm shaft or to return the pressurized oil to a drain. The switching valve can be, for example, a conventional electromagnetic two-way valve, known per se.

A working fluid other than oil, such as air, water, etc, can be utilized.

When the lock pin 45 is in the locked position, the pressurized oil in the bore 20 is released, and accordingly, the lock pin 45 is pushed by the spring 43 to push the piston 33 into the cylinder 31, so that the lock pin 45 enters a recess 48 coaxial to the cylinder 31 formed in the first arm 13A. As a result of the entrance of the lock pin 45 into the recess 48, the lock pin 45 renders the first and second arms 13A and 13B integral, so that relative rotation can no longer take place between the first and second arms. Namely, the two arms are locked.

It will be appreciated that the piston 33 has a shoulder **33*a* which prevents the front end of the piston 33 from projecting outward from the contact surface 36 toward the lock pin 45, when the piston 33 is pushed by the pressurized oil in the cylinder 31 toward the lock pin 45**.

According to an aspect of the present invention, the lock pin 45, the blind hole 41 receiving the lock pin, the cylinder 31, and the piston 33 all extend in the same direction X—X (FIG. 3) perpendicular to the axis Y—Y (FIG. 2) of the connecting shaft 15. Namely, the direction of movement of the lock pin 45 and the piston 33, i.e., the direction of action of the force is perpendicularly across the longitudinal axis of the shaft 15. With this arrangement, since the force is exerted on the lock pin 45 or piston 33 in the direction perpendicular to the axis of the shaft 15, both when the rocker arm 11 is locked and when it is unlocked, a force causing the first and second arms 13A and 13B to separate from one another is not exerted on the two arms.

The apparatus of the present invention operates as follows. First, in the lock position of the lock pin 45, i.e., in the operative position of the rocker arm 11, shown in FIGS. 3 and 4, the cylinder 31 is released from the pressurized oil and accordingly, lock pin 45 forces the piston 33 into the cylinder and partially enters the recess 48, as mentioned before. Therefore, the two arms 13A and 13B are integral with each other and, accordingly, the rocker arm 11 operates in the same fashion as the conventional single rocker arm. Namely, when the intake or exhaust valve (not shown) is made open, the cam lobe 24 of the cam 23 causes the valve stem 21 to move downward in accordance with the cam lift, by means of the rocker arm 11, as shown in FIG. 4, to open the associated valve. When the cam lobe 24 comes away from the rocker arm 11 during the rotation of the cam, the valve stem 21 is moved upwards by the spring 14 to close the associated valve.

When, for example, it is desired to make a predetermined intake or exhaust valve inoperative at a predetermined engine load, the pressurized oil is fed to the cylinder 31 from the oil supply unit 50, so that the piston 33 forces the lock pin 45 into the blind hole 41 against the spring 43 to release the lock. Thus, the rocker arm 11 is unlocked, and the two arms 13A and 13B of the rocker arm 11 can rotate relative to each other. Accordingly, when the rocker arm 11 is pushed down by the cam lobe 24, the second arm 13B rotates about the shaft 15 and is inclined relative to the first arm 13A to absorb the cam lift of the cam 23. In this manner, in spite of continuation of the rotation of the cam 23, the cam effect is cancelled out and is not transmitted to the valve stem 21, so that the associated intake or exhaust valve remains inoperative, i.e., remains closed. It should be noted that when the rocker arm 11 is in the unlocked position shown in FIG. 1, the lock pin 45 separates from the piston 33, but is still kept in an unlocked state by the curved contact surface 36 of the first arm 13A. The rocker arm 11 can be returned to the straight position identical to the operative position, in which the two arms 13A and 13B extend substantially straight, by means of the return spring 29 every time the cam lobe 24 comes away from the rocker arm 11.

Figure 5:
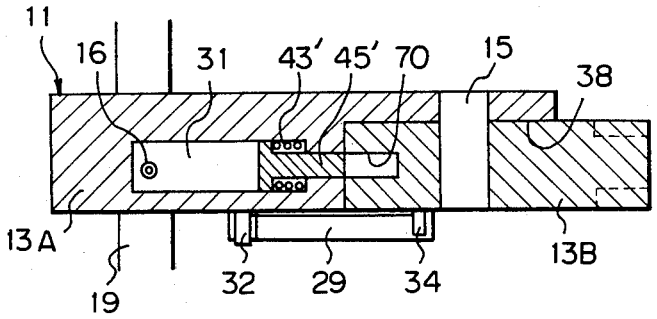
FIG. 5 is a view similar to FIG. 2 according to a second embodiment of the present invention.

FIG. 5 shows another embodiment of the present invention. The arrangement shown in FIG. 5 is different from that of the first embodiment shown in FIGS. 1 to 4 mainly in the location of the lock pin 45'. Namely, the lock pin 45' in the second embodiment shown in FIG. 5 is provided in the first arm 13A. The lock pin 45' is slidably located in the cylinder 31, which is formed in the first arm 13A, so that the lock pin 45' is continuously biased toward the unlocked position by means of the return spring 43'. The second arm 13B is provided with a blind hole 70 in which the lock pin 45' enters when the rocker arm 11 is locked. The hole 70 is opposed to the lock pin 45' in the cylinder 31, so that the lock pin 45', when pushed by the pressurized oil fed in the cylinder 31 against the spring 43', comes into the hole 70 to render the two arms 13A and 13B integral with each other. Since the lock pin 45' proper also fulfills the role of the piston 33 illustrated in FIG. 2, a particular actuator, such as the piston 33 can be dispensed with in the embodiment shown in FIG. 5.

Note that the operation of the apparatus illustrated in FIG. 5 is the same as that of the first embodiment except that the pressurized oil is supplied to the cylinder 31 from the oil supply unit 50 when the lock pin 45' is brought into the locked position, contrary to the first embodiment.

Although not illustrated, the lock pin 45 or 45' can be actuated by a mechanical means, such as a flexible wire or wire cable commonly used in a release mechanism in a camera, in place of the hydraulic actuator as shown in the aforementioned embodiments. In addition to foregoing, it is also possible to actuate the lock pin 45 or 45' by means of an electrical actuator, such as a solenoid means, or a vacuum actuator, such as a diaphragm means. These actuators can be then driven, for example, in accordance with an engine load.

As can be understood from the above discussion, according to the present invention, in a valve actuating apparatus having a so-called swing type or end pivot type rocker arm in which the rocker arm is rotatably connected at one end to the rocker arm shaft, bears at the opposite end against the valve stem, and bears at the intermediate portion against the cam to swing about the rocker arm shaft, a prodetermined valve or valves only can be easily and assuredly rendered inoperative.

Further, according to the present invention, since the locking and unlocking means act in the direction perpendicular to the axis of the connecting shaft, which rotatably connects the two arms of the rocker arm, no external force is exerted on the two arms to separate or expand them, thus preventing deviation of the rocker arm or displacement of the contacting portion between the rocker arm and the valve stem. Furthermore, according to the present invention, the width of the rocker arm in the direction parallel to the axis of the connecting shaft can be decreased in comparison with the prior art.

Figure 6:
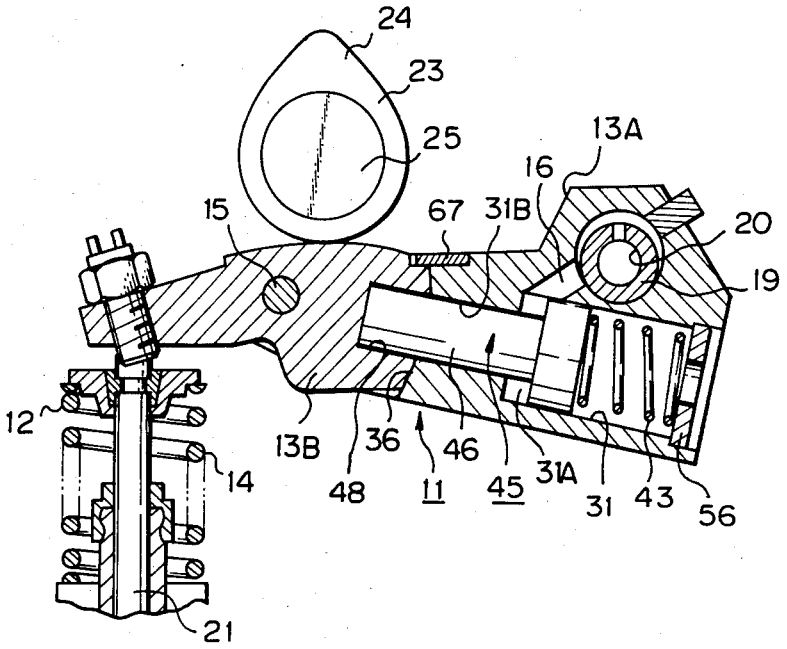
FIG. 6 is a sectional view of a valve actuating apparatus shown in a locked position, taken along the line VI—VI in FIG. 7, according to a third embodiment of the present invention.
Figure 7:
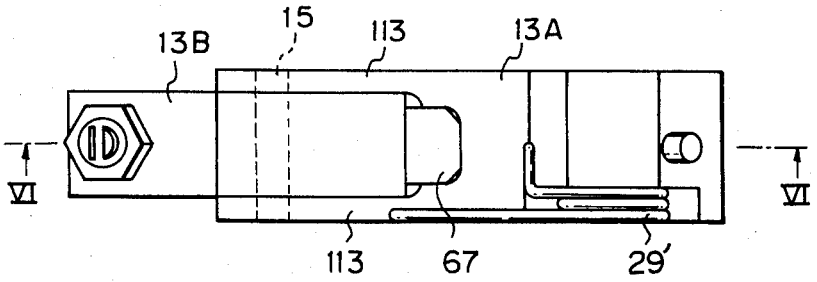
FIG. 7 is a plan view of FIG. 6.
Figure 8:
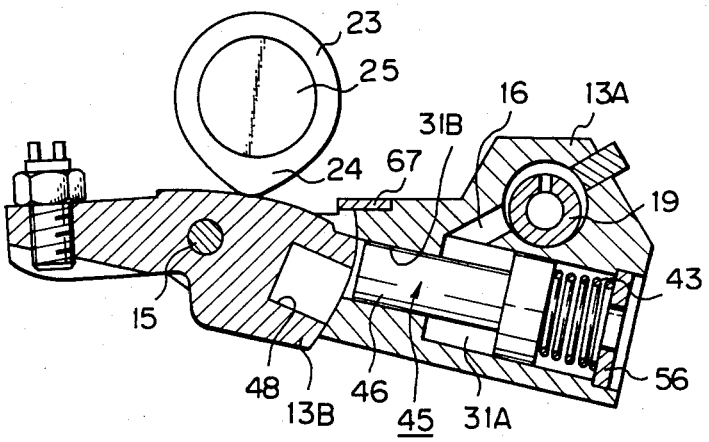
FIG. 8 is a view similar to FIG. 6 but shown in an unlocked position.

FIGS. 6 to 8 show another embodiment of the present invention, in which the construction of the apparatus is simplified in comparison with the aforementioned embodiments.

In the arrangement illustrated in FIGS. 6 to 8, the second arm 13B is slidably and rotatably held in a bifurcated end 113 (FIG. 7) of the first arm 13A. Note that the arrangements shown in FIGS. 6 and 8 are viewed as a reverse of the arrangements of FIGS. 1 and 3. In FIG. 7, the return spring 29 in FIGS. 1 to 5 is replaced by a coil return spring 29'. The coil spring 29' bears against the first arm 13A at one end and the second arm at the opposite end, respectively.

The lock pin 45 is slidably inserted in a stepped cylinder bore 31 corresponding to the cylinder bore 31 shown in FIG. 5. The stepped cylinder bore 31, which is formed in the first arm 13A, has a cylinder chamber 31A and a smaller diameter axial bore 31B connected to the cylinder chamber 31A. The lock pin 45 has a shaft portion 46 slidably extending in the axial bore 31B. The cylinder chamber 31A is hydraulically connected to the oil supply unit 50 (FIG. 1) through the oil passage 16 and the bore 20 of the cam shaft 18, similar to FIG. 1.

The shaft portion 46 of the lock pin 45 can be disengageably inserted in the recess 48 formed in the second arm 13B. The recess 48 is coaxial to the axial bore 31B in the locked position shown in FIG. 6 and has the same diameter as that of the axial bore 31B. The lock pin 45 is continuously biased toward the second arm 13B by the spring 43 provided in the cylinder bore 31.

When the pressurized oil is supplied to the cylinder chamber 31A to move the lock pin 45 to the right in FIG. 6, against the spring 43, the shaft portion 46 of the lock pin 45 is disengaged from the recess 48, so that the second arm 13B can rotate relative to the first arm 13A about the shaft 15. Namely, the lock pin is brought into the unlocked position when pressurized oil is supplied to the cylinder chamber 31A, as shown in FIG. 8.

The numeral 67 designates a stop plate secured to the first arm 13A to limit the rotational movement of the second arm 13B about the shaft 15 in the reverse direction, i.e., in the counterclockwise direction in FIG. 6.

According to the arrangement shown in FIGS. 6 to 8, since the recess 48 formed in the second arm 13B and the axial bore 31B formed in the first arm 13A are in alignment with each other in the locked position shown in FIG. 6 and have the same diameter, and since the cylinder bore 31 has the cylinder chamber 31A and the smaller axial bore 31B, the recess 48, the axial bore 31B, and the cylinder chamber 31A can be easily formed by drilling or machining at one time from the side of the cylinder bore 31. Namely, in spite of the fact that the recess and the cylinder bore are formed in the respective separate members, i.e., the second and first arms, respectively, the recess 48 and the cylinder bore 31 can be formed at one time, and accordingly, centering need not be taken into account, which centering would otherwise have to be precisely effected. The cylinder bore 41 is covered by an end plate 56 after the recess and the cylinder bore are formed.

According to the arrangement shown in FIGS. 6 to 8, since the recess 48 and the cylinder bore 31 can be machined at one time, as mentioned above, play between the lock pin 45 and the recess 48 can be eliminated or at least reduced.

The elements in FIGS. 6 to 8 corresponding to those of the first and second embodiments are designated by the same reference numerals as those in FIGS. 1 to 5.

The operation of the apparatus shown in FIGS. 6 to 8 is fundamentally identical to that of the first or second embodiment mentioned above.

FIGS. 9 to 11 show still another embodiment of the present invention.

In a variant illustrated in FIGS. 9 to 11, the lock pin 45 is provided with an axial hole 90 extending therethrough. Namely, the axial hole 90 opens at one end into a cylinder chamber 31C of the cylinder 31, which in turn opens to the atmosphere, and at the opposite end into the recess in which the shaft portion 46 of the lock pin 45 can be disengageably engaged, as mentioned before. The axial hole 90 serves as an air escape or air discharge hole through which the air which otherwise would be confined in the recess 48, and which could also provide a resistance against the movement of the lock pin into the recess 48, can be discharged into the atmosphere through the cylinder chamber 31C, when the lock pin 45 is forced into the recess 48. In this manner, the escape of the air otherwise confined in the recess 48 into the atmosphere through the axial hole 90 of the lock pin 45 ensures a smooth and quick movement of the lock pin 45 from and into the recess 48. It will be appreciated that if an air escape hole is not provided, the air confined in the recess 48 can be reduced in pressure when the lock pin 45 is quickly drawn out from the recess 48, resulting in a resistance to a quick and smooth movement of the lock pin 45. Namely, the axial hole 90 contributes to a smooth and quick movement of the lock pin not only in the forward but also the backward movement thereof.

The arrangement illustrated in FIGS. 9 to 11 is slightly different from that of FIG. 6, in addition to the presence of the axial air discharging hole in the lock pin 45. For example, in the arrangement shown in FIGS. 9 to 11, two coil springs 29' are provided on opposite sides of the first and second arms 13A and 13B; one end of each coil springs 29' is fitted in a corresponding slit 59 provided in the second arm 13B; an additional spring retainer 57 is provided on the end plate 56, which is in the form of a snap ring in the illustrated embodiment; and, the contact surface 36 of the first arm 13A is not curved but substantially flat, whereas only a contact surface 37 of the second arm 13B is arcuated. However, these differences have no significance in the working of the present invention.

We claim:

1. A valve actuating apparatus for intake and exhaust valves in an internal combustion engine having a swing rocker arm which is rotatably connected at its one end to a rocker arm shaft and at its opposite end bears against a valve stem of an associated intake or exhaust valve, and a rotatable cam which bears against the swing rocker arm to swing the latter about the rocker arm shaft, wherein said rocker arm is composed of a first arm which is rotatably connected to the rocker arm shaft and a second arm which bears against the valve stem and which is connected to the first arm by means of a connecting shaft extending in parallel to the rocker arm shaft, for relative rotation about the connecting shaft so that the two arms can selectively occupy an operative position in which the two arms are integral with each other and extend substantially straight so as to form a single rocker arm, and an inoperative position in which a relative rotation between the two arms takes place to absorb the rotation of the cam, and wherein said apparatus comprises locking means for preventing the relative rotation of the two arms to lock them to the operative position, unlocking means for releasing the lock at a predetermined time, and return means for continuously biasing the two arms toward the operative position to return them to the operative position when the lock is released, said locking means and unlocking means having directions of operation substantially perpendicular to and across the axis of the connecting shaft.

2. An apparatus according to claim 1, wherein said locking means comprises a lock pin which is slidably inserted in a pin hole provided in one of the first and second arms to receive the lock pin for sliding movement, and a recess provided in the other of the first and second arms to receive the lock pin in part only when the two arms are locked.

3. An apparatus according to claim 2, wherein said return means comprises at least one return spring which continuously biases one of the first and second arms toward the operative position.

4. An apparatus according to claim 2, wherein said unlocking means comprises a hydraulic actuator comprising a cylinder and a piston slidable therein to actuate the lock pin.

5. An apparatus according to claim 4, wherein said first and second arms are brought into surface contact with each other by a arcuated contact surface along which relative rotation takes place between the first and second rotation, and wherein said piston and said lock pin normally come into contact with each other at the arcuated contact surface.

6. An apparatus according to claim 4, further comprising a spring means for continuously biasing the lock pin toward the piston.

7. An apparatus according to claim 1, wherein said locking means and said unlocking means comprise a common lock pin provided in one of the first and second arms, a common hydraulic actuator for actuating the lock pin, and a recess provided in the other of the first and second arms for disengageably receiving the lock pin, said lock pin being continuously biased toward the inoperative position.

8. An apparatus according to claim 7, wherein said hydraulic actuator comprises a cylinder provided in said one of the first and second arms and wherein said lock pin is slidably inserted in the cylinder to actuate the lock pin when the two arms are locked.

9. An apparatus according to claim 4, wherein said cylinder has a stepped cylinder bore consisting of a large bore opening to the atmosphere and a smaller bore coaxial to the large bore, and wherein said recess for receiving the lock pin is coaxial to the smaller bore and has the same diameter as the smaller bore, so that the cylinder bore and the recess can be formed at one time from the side of the large bore of the cylinder bore.

10. An apparatus according to claim 8, wherein said cylinder has a stepped cylinder bore consisting of a large bore opening to the atmosphere and a smaller bore coaxial to the large bore, and wherein said recess for receiving the lock pin is coaxial to the smaller bore and has the same diameter as the smaller bore, so that the cylinder bore and the recess can be formed at one time from the side of the large bore of the cylinder bore.

11. An apparatus according to claim 2, further comprising air escape means for discharging the air confined in said recess into the atmosphere.

12. An apparatus according to claim 11, wherein said air escape means comprises an air passage provided in and extending through the lock pin.

* * * * *